US006694111B1

(12) United States Patent
Hirano

(10) Patent No.: US 6,694,111 B1
(45) Date of Patent: Feb. 17, 2004

(54) IMAGE FORMING APPARATUS, AND DEVELOPING DEVICE AND METHOD USED IN THE SAME

(75) Inventor: Kouji Hirano, Yokosuka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 53 days.

(21) Appl. No.: 10/216,357

(22) Filed: Aug. 12, 2002

(51) Int. Cl.[7] ..... G03G 15/06

(52) U.S. Cl. ..... 399/55; 399/281; 399/284; 399/285

(58) Field of Search ..... 399/53, 55, 279, 399/265, 280, 281, 282, 284, 285, 286

(56) References Cited

U.S. PATENT DOCUMENTS

| | | | | |
|---|---|---|---|---|
| 3,152,012 A | | 10/1964 | Schaffert | |
| 3,731,148 A | | 5/1973 | Fournis | |
| 5,781,827 A | * | 7/1998 | Shimada et al. | 399/55 |
| 5,953,557 A | * | 9/1999 | Kawahara | 399/88 |

FOREIGN PATENT DOCUMENTS

| | | | |
|---|---|---|---|
| JP | 47-13088 | | 7/1972 |
| JP | 47-13089 | | 7/1972 |
| JP | 5-289483 A | | 11/1993 |
| JP | 11-327222 A | | 11/1999 |
| JP | 2001-117367 | * | 4/2001 |
| JP | 2001-134093 A | | 5/2001 |

* cited by examiner

*Primary Examiner*—Hoang Ngo
(74) *Attorney, Agent, or Firm*—Foley & Lardner

(57) ABSTRACT

Developing device and method in an image forming apparatus are provided which can make it possible maintaining stabilized image by accurately controlling a toner carry amount. A developing roller is supplied with toner from a toner feed roller to form thereon a toner layer by application of a bias voltage to a toner layer forming member which is in pressing contact with the developing roller. When the operation is started (S1), the current flowing from the toner layer forming blade is detected for a predetermined length of time (S2). Based on the detected result, the current toner carry amount is selected, through the operation of CPU and ROM of a controller, from data D which are previously written in ROM (S3). If the selected toner carry amount is determined as an acceptable level that represents a predetermined amount or more (step 4), printing operation is started as it is. On the other hand, if the selected toner carry amount is determined as an unacceptable level that is less than the above predetermined amount, the toner carry amount is increased by an amount corresponding to the shortfall by selecting an appropriate feed bias (S5, S6).

10 Claims, 12 Drawing Sheets

START OF LIFE TEST 20,000 SHEETS PRINTED

TABLE 1

| TIME (sec) | CURRENT (μA) |
|---|---|
| 0.0 | 60 |
| 1.2 | 42 |
| VARIATION A (μA) | 18 |

TABLE 2

| VARIATION A (μA) | LEVEL | TONER AMOUNT (mg/cm²) |
|---|---|---|
| 0～10 | 5 | 0～0.2 |
| 11～20 | 4 | 0.21～0.4 |
| 21～30 | 3 | 0.41～0.5 |
| 31～40 | 2 | 0.51～0.6 |
| 40～ | 1 | 0.61～0.7 |

TABLE 3

| TIME (sec) | CURRENT (μA) |
|---|---|
| 0.0 | 60 |
| 3.6 | 30 |
| VARIATION B (μA) | 30 |

TABLE 4

| VARIATION B (μA) | LEVEL | TONER AMOUNT (mg/cm²) |
|---|---|---|
| 0～10 | 5 | 0～0.2 |
| 11～20 | 4 | 0.21～0.4 |
| 21～30 | 3 | 0.41～0.5 |
| 31～40 | 2 | 0.51～0.6 |
| 40～ | 1 | 0.61～0.7 |

TABLE 5

| | | VARIATION A (μ A) | | | | |
|---|---|---|---|---|---|---|
| | | LEVEL 1 | LEVEL 2 | LEVEL 3 | LEVEL 4 | LEVEL 5 |
| (μ A) VARIATION B | LEVEL 1 | ○ | ○ | × | × | × |
| | LEVEL 2 | ○ | ○ | × | × | × |
| | LEVEL 3 | × | × | × | × | × |
| | LEVEL 4 | × | × | × | × | × |
| | LEVEL 5 | × | × | × | × | × |

NOTE: ○ OK LEVEL
× NG LEVEL

TABLE 6

| | | VARIATION A (μ A) | | | | |
|---|---|---|---|---|---|---|
| | | LEVEL 1 | LEVEL 2 | LEVEL 3 | LEVEL 4 | LEVEL 5 |
| (μ A) VARIATION B | LEVEL 1 | ○ | ○ | P 1 | P 2 | P 3 |
| | LEVEL 2 | ○ | ○ | P 2 | P 3 | P 3 |
| | LEVEL 3 | P 1 | P 2 | P 2 | P 4 | P 4 |
| | LEVEL 4 | P 2 | P 3 | P 3 | P 5 | P 5 |
| | LEVEL 5 | P 3 | P 3 | P 4 | P 5 | P 5 |

TABLE 7

| POSITION | ADDITIONAL BIAS (v) |
|---|---|
| P 1 | −50 |
| P 2 | −100 |
| P 3 | −150 |
| P 4 | −200 |
| P 5 | −250 |

TABLE 8

| bit | 0 | 1 | 2 | ~ | 10 | ~ | 254 | 255 |
|---|---|---|---|---|---|---|---|---|
| (v) | 0 | -4 | -8 | | -39 | | -992 | -1000 |

VOLTAGE

TABLE 9

ADDITIONAL BIAS

| POSITION | (v) | BIT NUMBER |
|---|---|---|
| P 1 | −50 | 13 |
| P 2 | −100 | 25 |
| P 3 | −150 | 38 |
| P 4 | −200 | 50 |
| P 5 | −250 | 63 |

TABLE 10

TONER FEED ROLLER ROTATIONAL SPEED

| POSITION | (mm/sec) |
|---|---|
| P 1 | 57.6 |
| P 2 | 67.2 |
| P 3 | 76.8 |
| P 4 | 86.4 |
| P 5 | 96.0 |

IMAGE FORMING APPARATUS, AND DEVELOPING DEVICE AND METHOD USED IN THE SAME

BACKGROUND OF THE INVENTION

1. Field of the Invention

The present invention relates to developing method and device used in an image forming apparatus for visualizing an electrostatic latent image formed on a photosensitive body or photoreceptor by applying toner to the latent image.

2. Description of the Related Art

Electrophotography has been used extensively in electronic copier, laser beam printer, facsimile, etc. as a process of printing an image on a sheet of plain paper. Electrophotographic development can be roughly grouped into wet development and dry development, and generally the latter dry development system is more popularly used. The dry development system can be further grouped into two-component development and monocomponent development systems, of which the latter monocomponent development is prevailing predominantly in recent years as the developing system mainly for small-size printers and copiers. The monocomponent development system is characterized in that the developing agent for use contains no carrier (such as iron or ferrite powder) and the developing device of this type can be constructed more simply than that of the two-component type, thus offering advantages in terms of compactness and cost over the two-component type developing device.

As an example of such monocomponent development system, impression development is known in the art. This system is characterized in that toner particles or toner carriers are brought into contact with electrostatic latent image on a photosensitive drum, with the relative peripheral velocity therebetween being held substantially zero (see U.S. Pat. No. 3,152,012, U.S. Pat. No. 3,731,148, Japanese Patent Application KOKAI Publication No. S47-13088 and Japanese Patent Application KOKAI Publication No. S47-13089). This system dispensing with magnetic material has many advantages in that the developing device and the image forming apparatus can be constructed simpler in structure and smaller in size and also it makes easier to use color toners.

Though the developing device of monocomponent type is thus advantageous in terms of simplification and compactness of the image forming apparatus, because it has no carrier for charging the toner and transferring the charged toner to a developing roller, the developing system is inferior to two-component developing system in respect of toner chargeability and toner transfer capability (or toner transfer amount). Reduced charge amount or quantity of toner on the developing roller and reduced toner transfer amount must be avoided, because these will cause reduced transfer amount of toner to electrostatic latent image, thereby causing reduction in image density and irregular development and hence formation of poor image.

In order to solve these problems, Japanese Pat. Application KOKAI Publication No. H5-289483 discloses a developing device, in which an optical toner layer detector is disposed upstream of developing region and adjacent to and in opposing relation to the developing roller. In this developing device, toner carry amount on the developing roller is detected by the toner layer detector and controlling is done in such a way that the pressure of a toner layer forming member on the developing roller is adjusted according to the detected value so that toner carry amount on the developing roller is maintained substantially constant. In this system, however, the disposition of the toner layer detector in opposing relation to the developing roller increases the manufacturing cost and the size of the developing device, thus this system being contrary to the compactness feature of the monocomponent developing system.

Furthermore, Japanese Pat. Application KOKAI Publication No. 2001-134093 discloses a developing device in which a toner layer forming blade is made of an electrically conductive material such as metal and, with a toner layer formed on the developing roller, the toner carry amount on the developing roller is detected by measuring electrical current flowing to the toner layer forming blade.

However, since the developing roller and the toner layer forming blade are disposed in contact with each other under the predetermined pressure in the monocomponent developing system, toner filming tends to occur frequently on the developing roller. In such a case, the electrical resistance of the developing roller surface is increased and the value of current flowing to the toner layer forming blade is varied even if the toner carry amount on the developing roller is the same as in the initial state, with the result that maintaining constant the toner carry amount is difficult.

SUMMARY OF THE INVENTION

It is an object of the present invention to provide an image forming apparatus, and a developing device and method used in an image forming apparatus, which can make possible maintaining stabilized image by accurately controlling the toner carry amount, in order to solve the above-described problems.

In order to achieve this object, the present invention provides a developing device in an image forming apparatus of monocomponent development type, wherein a developing roller is supplied with toner from a toner feed roller to form thereon a toner layer through application of a bias voltage to a toner layer forming member, while said toner layer forming member is pressed against said developing roller, comprising: a toner recovery system for recovering toner from said developing roller; a current variation detector for detecting variations in current flowing through said toner layer forming member applied with the bias voltage when feeding toner, during image forming operation, onto said developing roller from which the toner has been recovered by said toner recovery system; and a toner carry amount controller for controlling an amount of toner carried onto said developing roller on the basis of said variations in current.

In this case, the current variation detector may comprise a current detector for detecting current flowing through said toner layer forming member, a timer for counting time, and computing means for determining a difference in value of currents detected by said current detector before and after a predetermined time counted by said timer. Furthermore, the above predetermined time may be counted from the beginning of rotation of said developing roller.

Furthermore, in the developing device provided in the image forming apparatus according to the present invention, the current variation detector is operable to detect variations in current for each of first and second predetermined times having different lengths as counted from a beginning of rotation of said developing roller, and the toner carry amount controller is operable to control said toner carry amount on the basis of said detected current variation amounts for said first and second predetermined times. Furthermore, the toner carry amount controller may have tables of data of control quantities corresponding to the respective current variation amounts for said first and second predetermined times and is operable to control said toner carry amount on the basis of the control quantities found from said tables.

Furthermore, in the developing device in an image forming apparatus according to the present invention, the toner carry amount controller may operate to change the bias voltage for application to said toner layer forming member on the basis of said current variation. Alternatively, the toner carry amount controller may be operable to change the rotational speed of said toner feed roller on the basis of said current variation.

Still further, in the developing device provided in the image forming apparatus according to the present invention, the toner carry amount controller may be characterized in that it is operable so as to increase the toner carry amount if said controller determines on the basis of said variations in current that an amount of toner carried to said developing roller is at or below a predetermined amount, or under a predetermined amount.

The present invention further provides a developing method in an image forming apparatus of monocomponent development type, wherein a developing roller is supplied with toner from a toner feed roller to form thereon a toner layer through application of a bias voltage to a toner layer forming member, while said toner layer forming member is pressed against said developing roller, comprising the steps of: recovering toner from said developing roller by said toner feed roller at the end of image forming operation of said image forming apparatus; detecting variations in current flowing through said toner layer forming member during re-supply of toner to said developing roller at the start of image forming operation of said image forming apparatus; and controlling an amount of toner carried onto said developing roller by said toner feed roller on the basis of said variations in current.

The present invention still further provides an image forming apparatus comprising: a photoreceptor on which a latent image is formed; a developing roller for visualizing the latent image by feeding toner to said photoreceptor; a toner feed roller for feeding toner to said developing roller; a toner layer forming member applied with a bias voltage and pressed against said developing roller to form a toner layer on said developing roller; a toner recovery system for recovering toner on said developing roller; a current variation detector for detecting variations in current flowing through said toner layer forming member applied with the bias voltage when feeding toner, during image forming operation, onto said developing roller from which the toner has been recovered by said toner recovery system; and a toner carry amount controller for controlling an amount of toner carried onto said developing roller on the basis of said variations in current.

DESCRIPTION OF THE PREFERRED EMBODIMENTS

Figure 1:
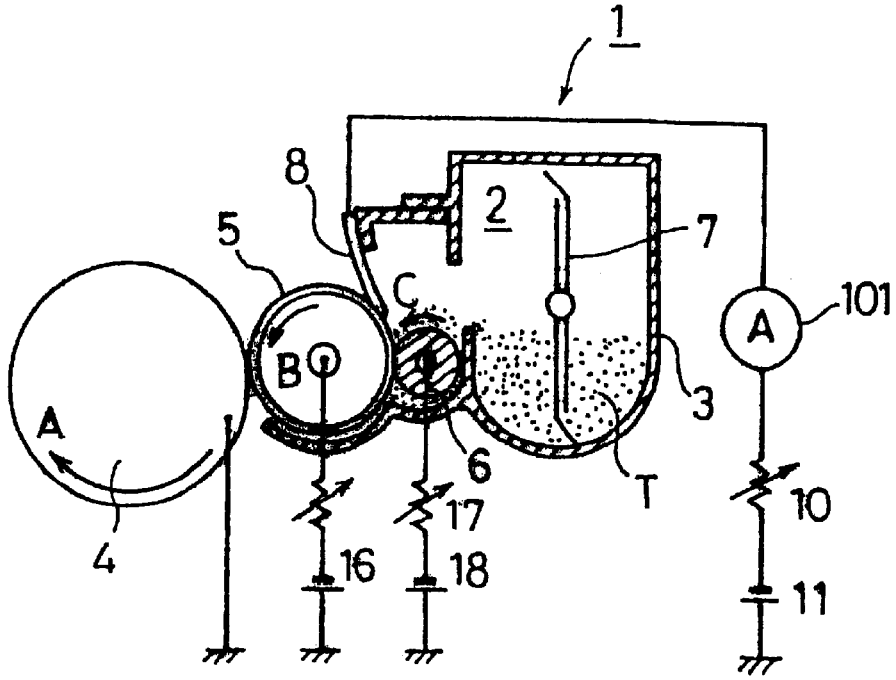
FIG. 1 shows a schematic construction of a monocomponent developing device to which embodiments of the present invention may be applied.

The following will describe preferred embodiments of the present invention while having reference to the accompanying drawing, wherein like reference symbols in the drawings designate like or corresponding parts. As will be understood from the description below, the present invention is not limited to the illustrated embodiment, but various changes therefrom are possible.

FIG. 1 illustrates a nonmagnetic monocomponent developing device used, e.g., in a digital PPC (plane paper copier) and laser beam printer to which the embodiment of the present invention is applicable. The developing device 1 of FIG. 1 includes a toner hopper 3 constructed integrally with the developing device 1 and defining therein a toner storage 2 in which nonmagnetic toner T as a monocomponent developing agent is stored. The developing device 1 has an opening at a portion thereof which faces a photosensitive drum 4 as an image bearer of the image forming apparatus, and a developing roller 5 which is rotatable (in a direction of arrow B) in contact with the photosensitive drum 4 rotatable in a direction of arrow A, is disposed adjacent to the opening of the developing device 1. At the bottom of the toner storage 2 is provided a toner feed roller 6 which is rotatable in a direction of arrow C in contact with the developing roller 5 for feeding toner T in the toner storage 2 onto the developing roller 5. There is provided a mixer 7 in the toner hopper 3 for feeding toner T into the toner storage 2 while mixing.

The developing device 1 further includes a blade 8 located adjacent to the upper portion of the developing roller 5 for regulating the toner amount carried by the developing roller 5 so as to form a thin layer of toner T on the surface of the developing roller 5. The blade 8 is made of a thin metal spring plate and connected at one end thereof to the developing device body. The blade 8 is connected to a bias voltage source 11 by way of a variable-voltage device 10 so that a blade bias voltage of a predetermined magnitude is applied to the blade 8. In the line connecting the blade 8 and the variable-voltage device 10 together, a detector 101 is also connected for detecting the current flowing during application of the bias.

Similarly, the toner feed roller 6 is connected to a bias voltage source 18 through a variable-voltage device 17, and the developing roller 5 is also connected to a bias voltage source 16 through a variable-voltage device so that toner feed bias voltage and developing bias voltage of predetermined magnitudes are applied to the toner feed roller 6 and the developing roller 5, respectively.

With the arrangement being as such, toner T in the hopper 3 is fed by the mixer 7 toward the toner feed roller 6 in the toner storage 2 while being mixed by the mixer 7, and the toner feed roller 6 in turn feeds toner T to the developing roller 5. As mentioned earlier, bias voltages are applied to the toner feed roller 6 and the developing roller 5, respectively, wherein the relationship between the two bias voltages is |toner feed bias|≧|developing bias|. Toner T fed to the developing roller 5 by the toner feed roller 6 is subjected to triboelectric charging, so that the toner T is carried toward the blade 8 under the actions of static electricity, physical force and potential difference. While its passing amount is regulated by the blade 8, the toner T on the developing roller 5 is electrically charged under the influence of charge injection by the blade bias voltage applied to the blade 8 and of triboelectric charging. The relation between the two bias voltages applied to the blade 8 and the developing roller 5 is |blade bias|>|developing bias|. After moving past the blade 8, toner T is charged sufficiently and a substantially uniform toner layer is formed on the developing roller 5.

Since the photosensitive drum 4 in the embodiment of the present invention is of negative-charge type using an organic photoreceptor for reverse development, toner T is negatively charged. The developing roller 5 is disposed to be pressed against the photosensitive drum 4 with a constant load so that a predetermined width of contact (developing nip) is provided therebetween. It is so arranged that part of the toner T moving past the developing nip and not contributing to image development is recovered by a not shown recovery blade and returned to the toner storage 2.

Figure 2:
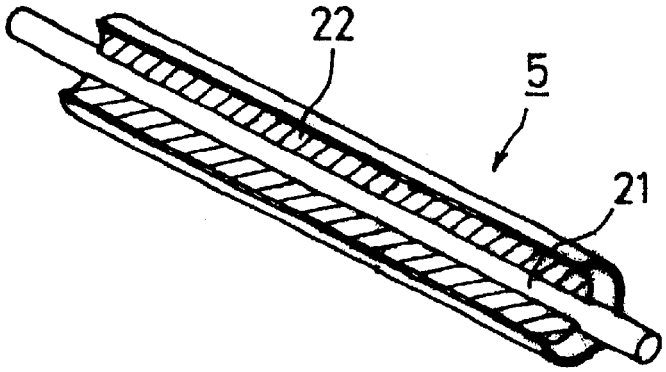
FIG. 2 is a partially cutaway perspective view showing a developing roller for use in the developing device of FIG. 1.
Figure 3:
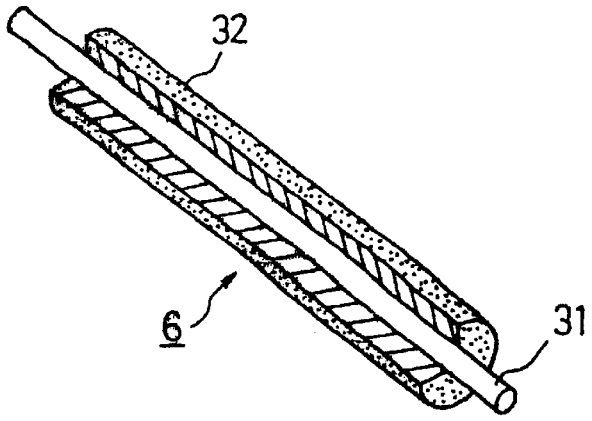
FIG. 3 is a partially cutaway perspective view showing a toner feeding roller for use in the developing device of FIG. 1.

Since the developing roller 5 is disposed in contact with the photosensitive drum 4 in the embodiment of the present invention, a roller having a smooth and elastic surface is used for the developing roller 5. As shown in FIG. 2, the developing roller 5 includes a metal shaft 21 and a conductive elastic layer 22 formed thereround, and a bias voltage is applied to the metal shaft 21. As shown in FIG. 3, the toner feed roller 6 includes a metal shaft 31 and a conductive urethane foam layer 32 covering the metal shaft 31, and a bias voltage is applied to the metal shaft 31.

Figure 4A:
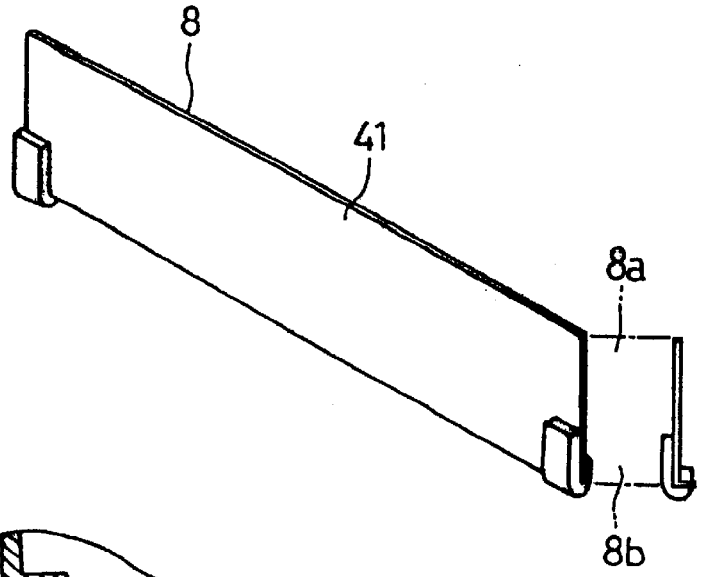
FIG. 4(A) is a perspective view of a toner layer forming blade for use in the developing device of FIG. 1, illustrating a process of making such toner layer forming blade.
Figure 4B:
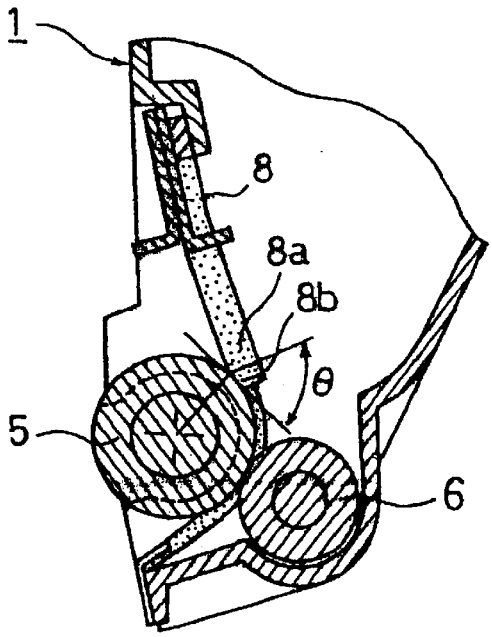
FIG. 4(B) is a partially enlarged cross-sectional view showing how the toner forming blade is mounted in the developing device of FIG. 1.

Since the blade 8 used in the embodiment of the present invention is applied with a bias voltage, it is made of an elastic metal plate and urged into contact with the developing roller 5 under the predetermined pressure caused by the elastic deformation of its material, so that the toner layer on the developing roller 5 and the charge amount thereto are regulated to predetermined values, respectively. Referring to FIGS. 4(A) and 4(B), the blade 8 is made of a stainless steel plate 41, and the tip end portion 8*a* thereof, which is in contact with the developing roller 5, is bent slightly away from the peripheral surface of the developing roller 5 and the blade 8 has an inclined surface 8*b*. Therefore, the angle θ defined between a line extending perpendicular to the longitudinal axis of the blade 8 and the inclined surface 8*b* is smaller than 90 degrees.

In the following, there will be a general explanation about structure and operation of a printer, having incorporated therein the above-described developing device 1, made with reference to FIG. 5. Firstly, a not shown power switch is turned on and the printer is warmed up. That is to say, the heater (not shown) of a fixing device 58 is activated and the surfaces of respective rollers 58*a* and 58*b* of the fixing device 58 are heated to a predetermined temperature. Then, a main motor (not shown) is operated to rotate the photosensitive drum 4 at a predetermined speed (32 mm/sec in the embodiment). At a predetermined timing, a voltage of a predetermined magnitude (surface voltage) is applied to the surface of the photosensitive drum 4 by a charging device. Simultaneously, a bias voltage having a polarity reverse to that of the above voltage is applied to each of the developing roller 5, toner feed roller 6 and blade 8 of the developing device 1, and the developing roller 5 is rotated at a predetermined speed. Furthermore, when a certain portion on the photosensitive drum 4 charged to a predetermined voltage reaches where it faces the developing roller 5, the bias voltages applied to the developing roller 5, toner feed roller 6 and blade 8 are changed to predetermined levels, respectively. Thus, the surface potential of the photosensitive drum 4 is stabilized (or aged).

As the surface potential of the photosensitive drum 4 has been stabilized and the temperature of the fixing device 58 has reached a predetermined level by such warming-up operation, it is enabled to receive a print-start command from an external device (not shown). When a record-start command is provided from the external device at an appropriate timing and print data transmission is permitted by CPU 60*a* of a controller 60, the print data is transmitted to a buffer memory 61 from the external device. The print data stored in the buffer memory 61 is subject to a predetermined image processing in RAM 60*c* of the controller 60 and converted into an image date corresponding to the pattern of light intensity of laser beam to be outputted by a semiconductor laser device (not shown) of an exposure device 3, whereupon the image data is supplied to a print image signal generating circuit 62. The print image signal generating circuit 62 changes the intensity of the laser beam emitted from the semiconductor laser device (not shown) of the exposure device 3 in correspondence to the image data so that the electric charge of the photosensitive drum 4 charged previously to a predetermined surface potential level can be selectively attenuated to a desired level. In this manner, the laser beam emitted from the exposure device 3 is reflected on a not shown exposure mirror and exposed to given area on the peripheral surface of the photosensitive drum 4.

The photosensitive drum 4 is charged to a predetermined surface potential by the charger 52 before the laser beam whose intensity has been changed in accordance with the image data is emitted, and its surface potential is selectively attenuated in accordance with the supplied image data, thus an electrostatic latent image corresponding to the image data being formed and held on the photosensitive drum 4. The electrostatic latent image formed on the peripheral surface of the photosensitive drum 4 is visualized into a toner image by toner supplied from the developing device 1, and the toner image is transferred by the transfer device 55 onto image recording medium P supplied. from a paper cassette (not shown) or a manual paper feeder (not shown). The transfer device 55 initiates the transferring when a transfer bias voltage is applied thereto at an appropriate timing by a transfer power source 57. The toner image transferred to the image recording medium P by the transfer device 55 is separated from the photosensitive drum 4 and conveyed with the image recording medium P toward the fixing device 58, and the recording medium P having the toner imaged applied thereon is guided between the fixing rollers 58*a*, 58*b*of the fixing device 58. The toner image guided through the fixing device 58 is fixed to the image recording medium P under the influence of heat and pressure from the fixing rollers 58*a*, 58*b*, and the recording medium P is ejected out of the printer.

After the toner image has been transferred to the image recording medium P. on the other hand, the photosensitive drum 4 undergoes cleaning to remove residual toner remaining on the surface of the photosensitive drum 4 by means of a photosensitive body cleaner 56 for reuse of the residual toner for further image forming. When image forming operation is performed continuously for two times or more, a series of the aforementioned operations is repeated for the required number of times.

Detection of a carry amount of toner on the developing roller 5 is performed after image forming process has been completed and before the beginning the next process. It is not always necessary to perform this detection for each development of electrostatic latent image, but it may be performed at any desired predetermined timing, for example one time of detection for development of a predetermined number of prints. The detection of the toner carry amount is conducted in the manner which will be described below.

Figure 6A:
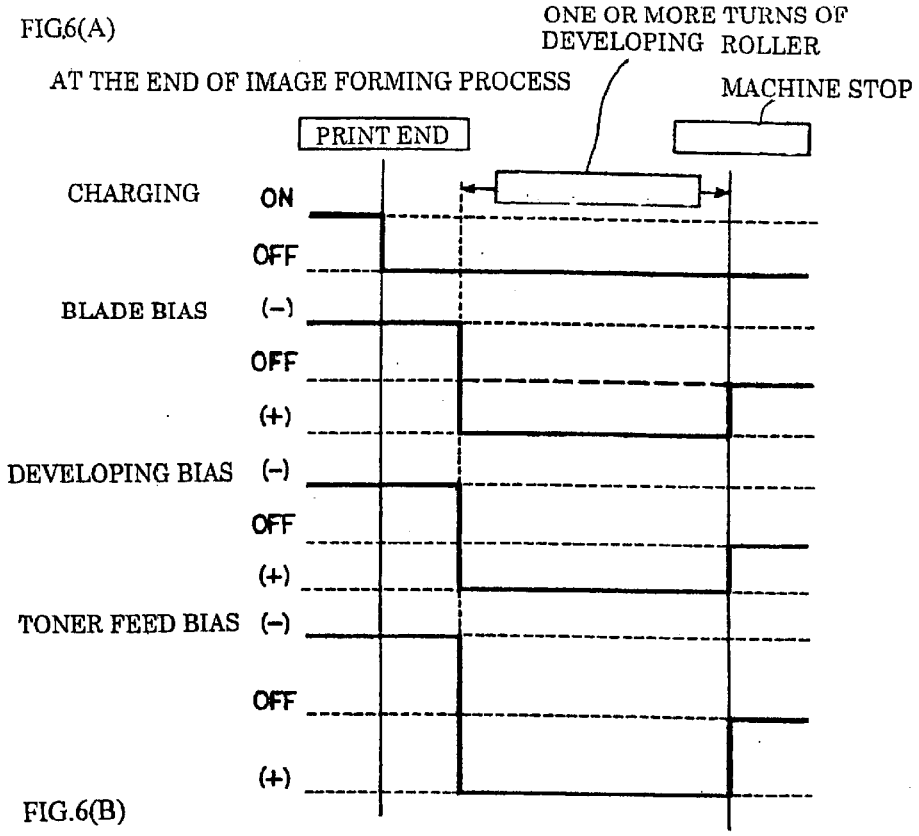
FIG. 6(A) is a timing chart showing ON/OFF states of various elements of the developing device at the end of an image forming process.
Figure 6B:
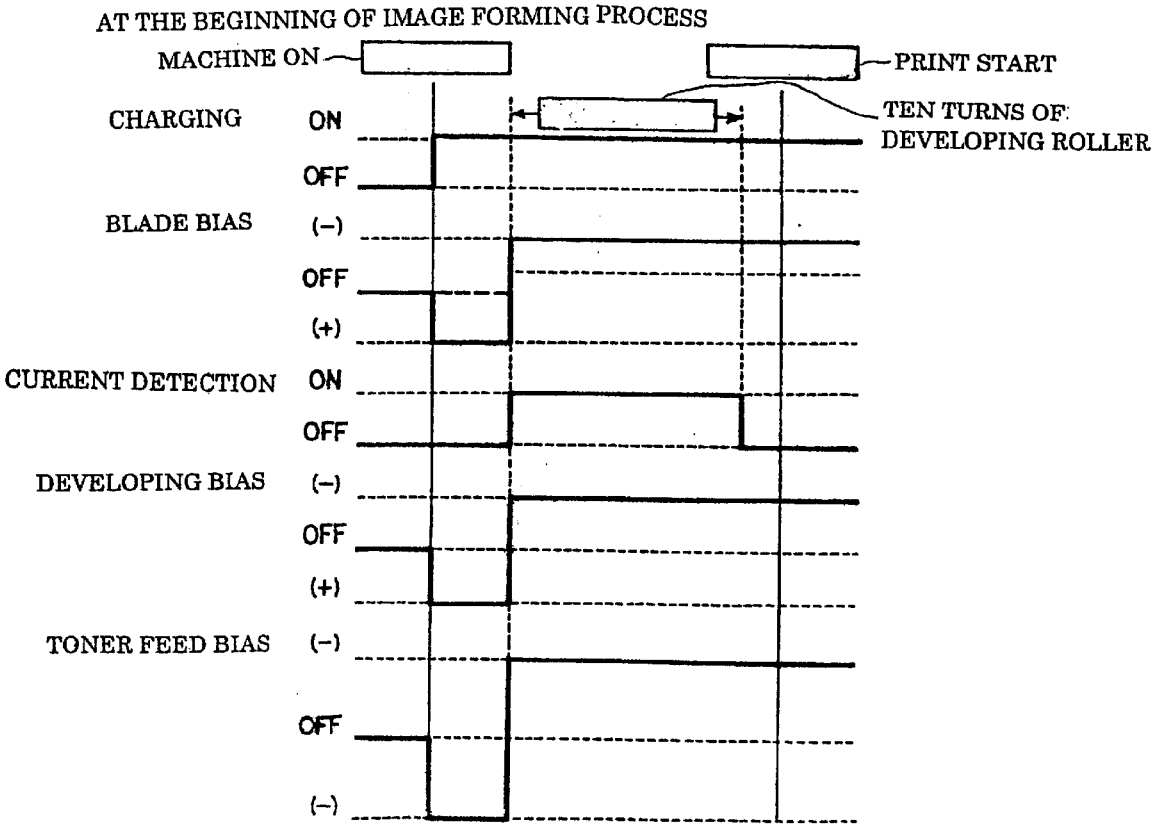
FIG. 6(B) is a timing chart showing ON/OFF states of the various elements of the developing device at the beginning of an image forming process.

FIGS. 6(A) and 6(B) provide timing charts showing the behavior of charging potential, developing bias and feed bias, etc. at the end of the image forming process and at the beginning of the image forming process, respectively. Firstly, at the end of the image forming process of FIG. 6(A), the charging device 52 is turned off and the surface potential of the photosensitive drum 4 becomes 0 V. As the portion on the photosensitive drum 4, whose surface potential has become 0 V, comes in facing relation to the developing roller 5, the developing roller 5 is applied with a developing bias voltage of a reverse polarity (positive in the embodiment) so as to prevent the toner on the developing roller 5 from being transferred to the photosensitive drum 4. Feed bias of reverse polarity (positive in the embodiment) is applied to the toner feed roller 6 at the same timing of bias application to the developing roller 5, wherein the relationship between the developing bias and feed bias is |developing bias|<|feed bias| so that toner present on the developing roller 5 is recovered by the toner feed roller 6. After the developing roller 5, etc. have been rotated at a predetermined speed for a length of time corresponding to one turn or more of the developing roller 5 (1178 msec or more in the embodiment) with the biases applied, operation of the printer is completed. It is desirable that at the end of the above image forming process the blade bias should be off as indicated by dotted line, or alternatively set at the same potential as the developing bias as indicated by solid line.

As mentioned earlier, at the beginning of image forming process of FIG. 6(B), the developing roller 5 and the toner feed roller 6 are rotated in synchronism with the rotation of the main motor (not shown) for rotating the photosensitive drum 4. At this beginning, contrary to the end of image forming process, the developing roller 5 and the toner feed roller 6 are applied with such biases that the toner is transferred from the toner feed roller 6 to the developing roller 5, that is bias voltages for normal operation are applied. Likewise, a blade bias is applied to the blade 8. At this time, as will be described in detail in later part hereof, the value of current flowing from the blade 8 and varying with the amount of toner transferred from the toner feed roller 6 to the developing roller 5 is observed by monitoring the current value with the detector 101 (FIG. 1) for a length of time corresponding to, for example, about 10 turns of the developing roller 5 from the beginning of its rotation (12.0 seconds in the embodiment). The blade bias voltage during this time corresponds to that applied during normal operation. The length of time for monitoring the current variation may be changed as required depending on the operating speed of the printer or warming-up time.

Figure 7:
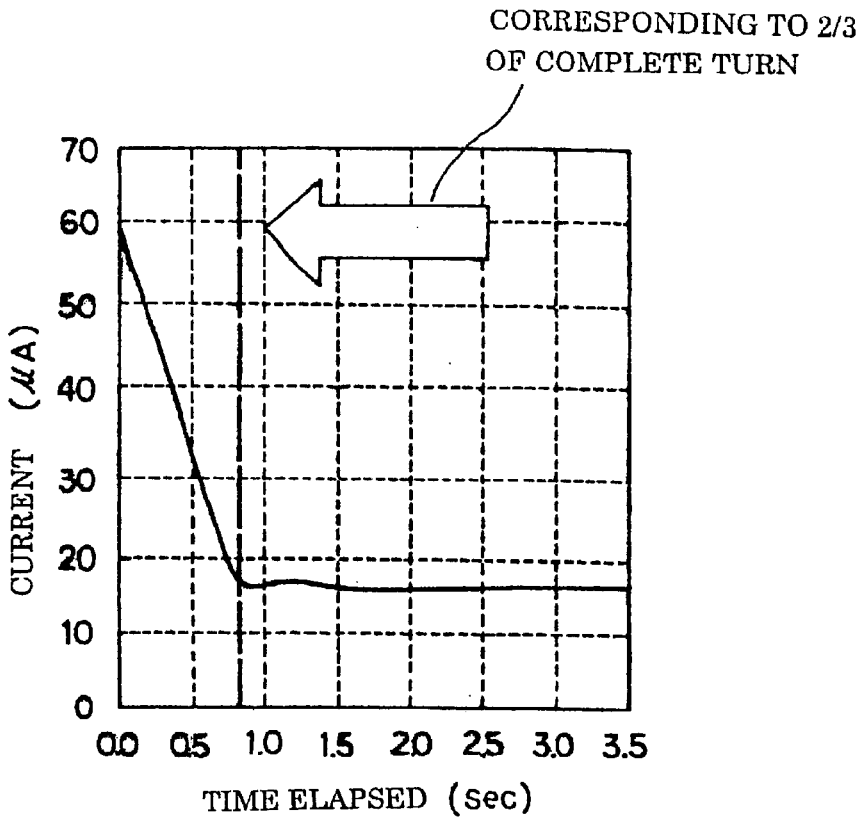
FIG. 7 is a graph showing an example of variation in electric current flowing from the toner forming blade and monitored by a detector.
Figure 8:
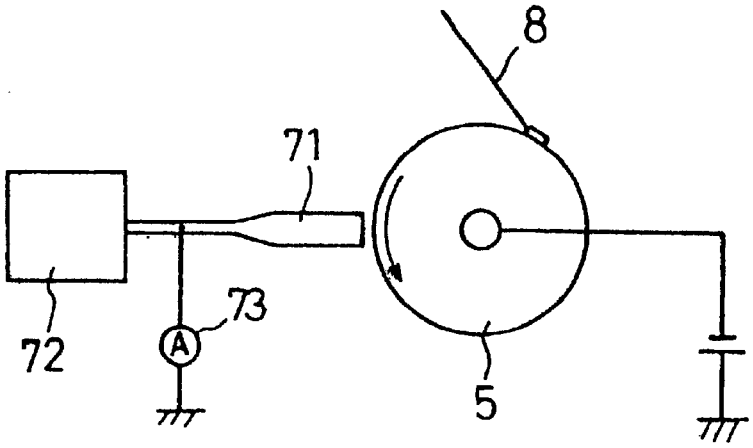
FIG. 8 is a schematic view of a measuring device for measuring the toner carry amount on the developing roller.

As seen from FIG. 7 which shows an example of current variation as observed in the above-described method, the current value is stabilized after elapse of time corresponding to about two-thirds of a complete rotation of the developing roller. The following will deal with the relationship between the toner carry amount onto the developing roller and the current value. The toner carry amount was measured in the following method. FIG. 8 shows a schematic view of a measuring device. The measuring method includes disposing a suction attachment (opening area S=20 $cm^2$) 71 in opposing relation to the developing roller 5 on which a toner layer is formed and drawing the toner layer by a suction device 72. From the variation in weight Wd1 of the developing device before and after the toner drawing and the electric charge amount Qt1 measured by a micro-ammeter 73 when the toner separated from the developing roller 5 passes through a Faraday gage, the toner layer amount ml per unit area and the toner charge amount Q1 under a steady state can be calculated as follows:

$$m1=Wd1/S(\mathrm{g/cm^2})$$

$$Q1=Qt1/Wd1(\mu/\mathrm{g})$$

Figure 9:
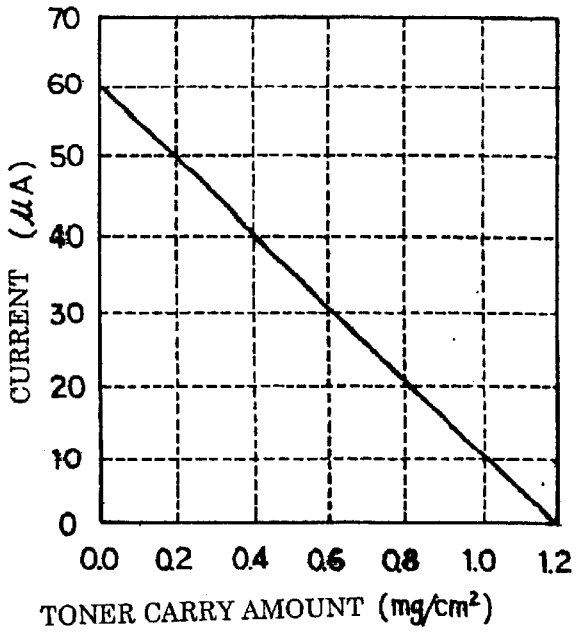
FIG. 9 is a graph showing the relationship between the toner carry amount and the value of current flowing from the toner forming blade.

The relationship between the toner carry amount thus measured and the value of current then flowing from the blade 8 is shown in the graph of FIG. 9. The graph shows that the current flowing from the blade 8 varies with the toner carry amount and, therefore, it can be appreciated that the toner carry amount can be known by observing the current of the blade 8.

In the above-described printer, a reduced density was observed in a solid image at the downstream end portion thereof as seen in the movement of a sheet with an increasing number of prints (which may be expressed as progression of life). The toner carriability in printing solid image was defined as follows:

$$\text{Solid image toner carriability}=De/Ds\times 100$$

wherein, Ds: Image density at upstream portion of solid image

De: Image density at downstream portion of solid image

Figure 10:
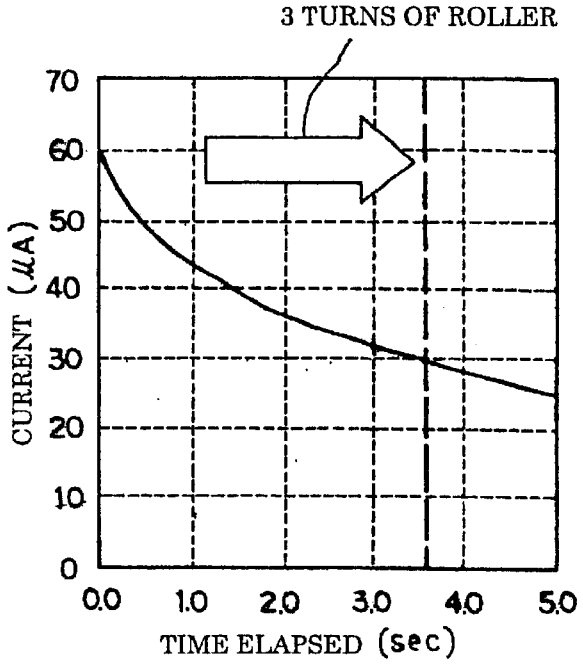
FIG. 10 is a graph showing variation of the value of current flowing from the blade when toner carriability in solid image formation is reduced below 85%.

In recent years, there has been an increasing demand for high density in printing images such as graphics and it is known that, if the solid image toner carriability is reduced below 85%, the image density variation become greater, thereby producing poor images. Results obtained from observing variation in the current flowing thereafter from the blade 8 are shown in FIG. 10. It can be seen from the drawing that the variation in the current continues even after an elapse of time corresponding to three turns of the developing roller 5 from the start of its rotation, so that the toner carry amount is remarkably reduced. This is due to insufficient toner carry amount for the development, occurring in printing a solid image in a developing system in which the developing roller 5 has therein no magnetic poles and toner is carried without making use of such magnetism. Though it has been confirmed that the toner carriability can be improved by increasing the potential difference between the developing roller 5 and the toner feed roller 6, if the printer should be set initially with such a potential difference, toner carry amount becomes excessive and fogging on the photosensitive drum 4 is increased, with the result that the toner consumption is badly affected and fogging appears on the image background, thus causing the image to be deteriorated. Therefore, it is desirable to provide an arrangement in which the toner carry amount is predicted from the current flowing from the blade 8 as described earlier herein so as to achieve appropriate toner carry amount.

Figure 11:
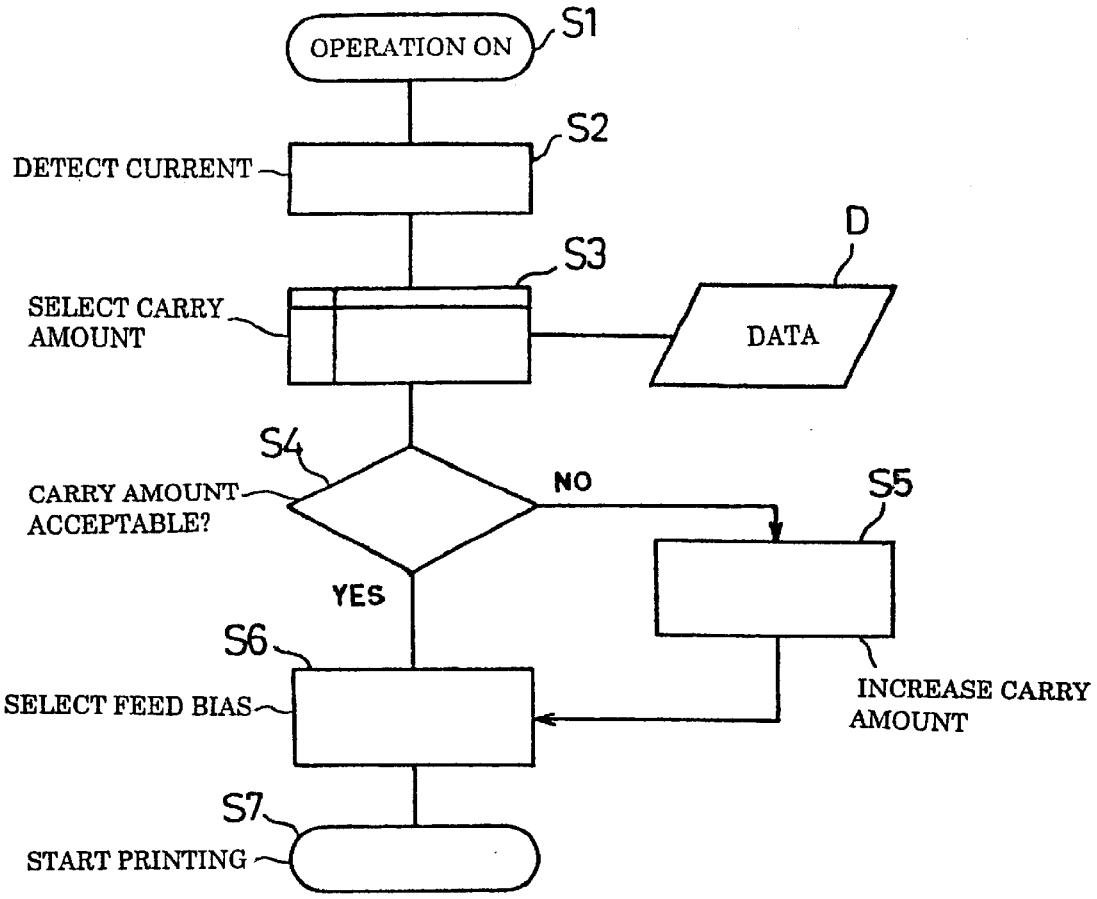
FIG. 11 is a flow chart of developing method as applied to a printer according to the preferred embodiment of the present invention.

FIG. 11 is a flow chart showing a manner of controlling which is applied to the printer according to the embodiment of the present invention. In FIGS. 1, 5 and 11, as the printer operation is energized (step S1), detection of current flowing from the toner layer forming blade 8 is made by the detector 101 in a predetermined length of time (S2). According to the detection result, the current toner carry amount is selected by and between CPU 60*a* and ROM 60*b* of the controller 60 from data D (see Tables 1 through 4) by which are previously written in ROM 60*b* (step S3). If the selected toner carry amount is determined as acceptable level that is a predetermined amount or more (85% or more in the embodiment) (step 4), printing operation is started as it is. On the other hand, if the selected toner carry amount is determined as unacceptable level that is less than the above predetermined amount, an operation is effected to effect increasing the toner carry amount by an amount corresponding to the shortfall by selecting an appropriate feed bias (S5, S6, see Tables 5 through 9) and the printing operation is started (S7).

The operation necessary for increasing the toner carry amount will be now explained. As a method of increasing the carry amount of toner to the developing roller 5, (1) changing the bias voltage for application to the toner feed roller 6 so as to increase the difference thereof from the developing bias; or (2) changing the RPM of the toner feed roller 6 itself so as to increase the rotational speed;

can be contemplated and both methods are feasible. However, since the method (2) requires using a mechanism for changing the rotational speed, which makes the developing device complicated and also causes a possible load on a toner feeding roller motor to be increased, it is desirable to use electrical action to change the bias voltage for application to the toner feed roller so as to increase the difference thereof from the developing bias according to the method (1). Therefore, the following will further explain the method of changing the bias voltage.

Figure 12:
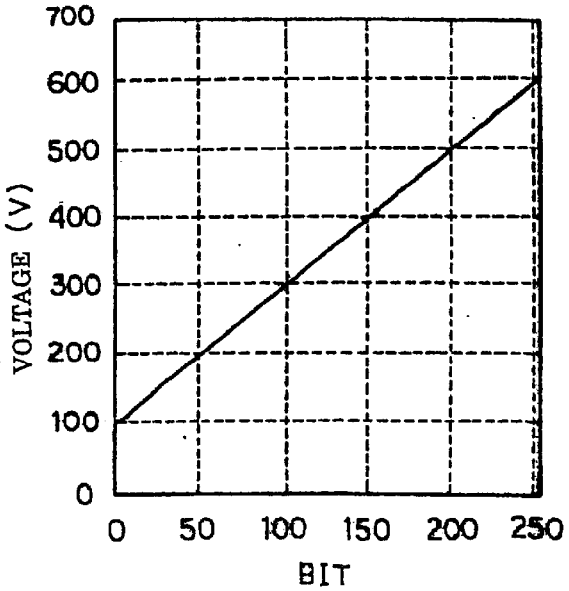
FIG. 12 is a graph showing the relationship between bias voltage applied to the toner feeding roller and bit number divided into 256 bits as a function.

FIG. 12 is a graph showing a relationship between bias voltage for application to the toner feed roller 6 (abbreviated as toner feed bias hereinafter) and the number of bits divided into 256 bits. Setting of the toner feed bias is controlled in terms of the number of bits divided into 256 bits, and data of the number of bits in the initial setting and voltage variation per one bit are stored in ROM 60*b* (see Table 8).

Figure 13:
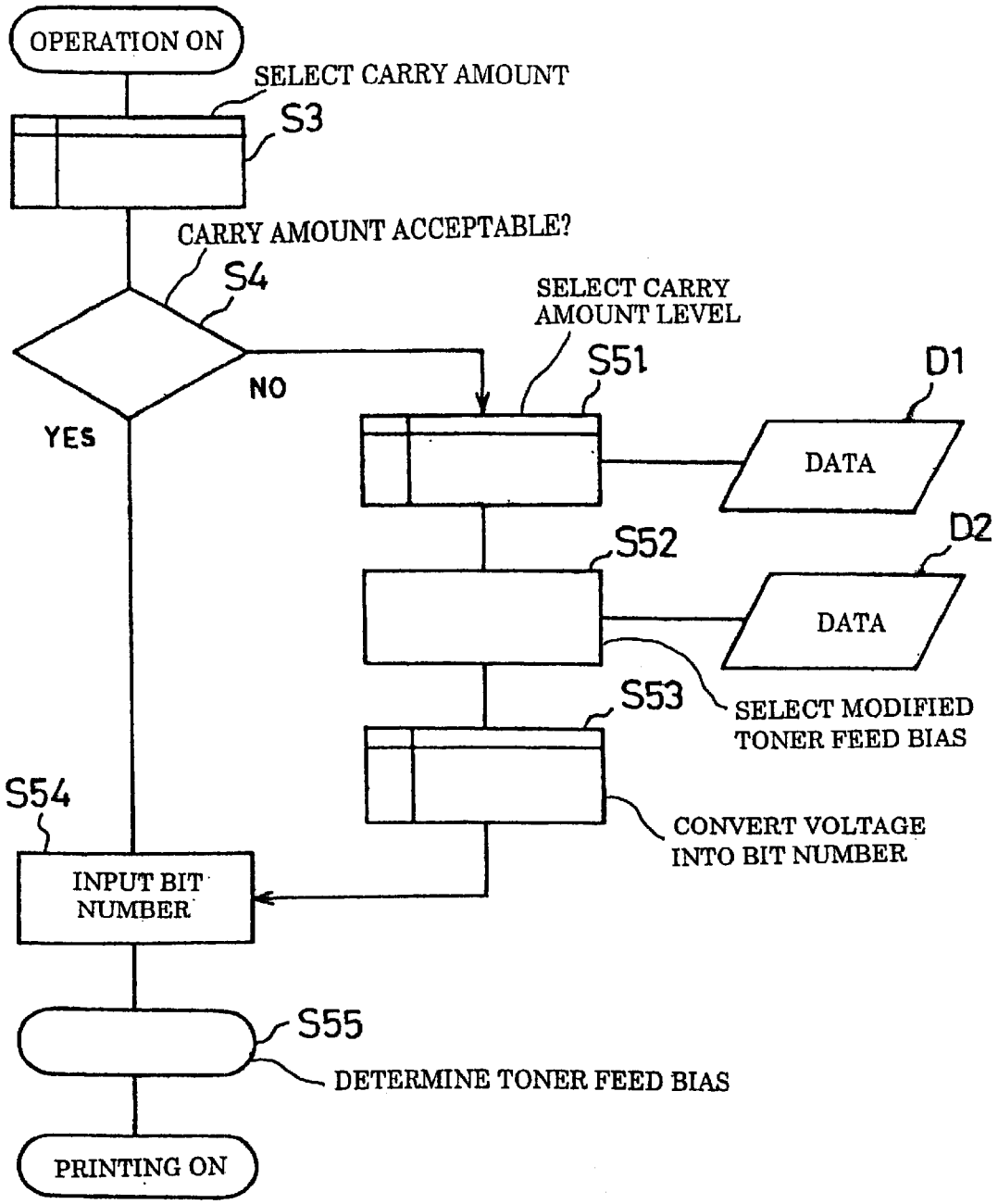
FIG. 13 is a flow chart showing a manner of changing the toner feed bias in the developing method of the present invention.

FIG. 13 is a flow chart showing the operation for toner feed bias changing. If shortage of toner carry amount is found as mentioned earlier, the current level of toner carry amount is determined by and between CPU 60*a* and ROM 60*b* with reference to various data D1 (S51). Based on this current level of toner carry amount, value of toner feed bias to be added is selected (S52), and this additional value of toner feed bias is substituted by the number of bits with reference to voltage-bit table stored in ROM 60*b* (S53, Data D2, Tables 8 and 9). Then, CPU 60 informs the toner feed bias source of the changed bit number (S54) and the modified toner feed bias is applied for the subsequent printing operation (S55).

Figure 14A:
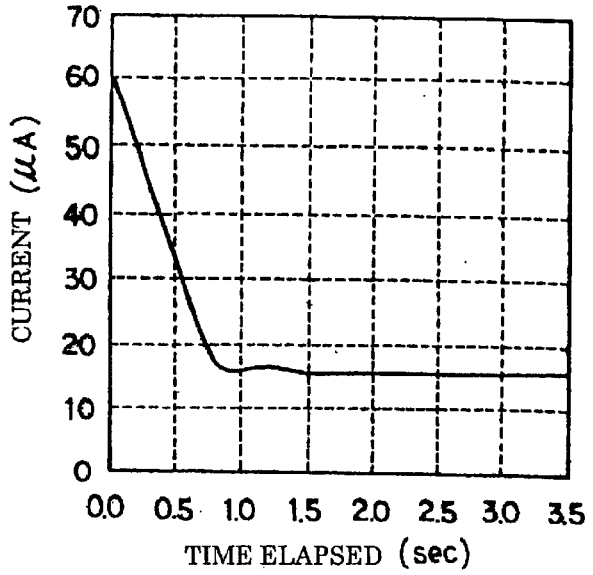
FIGS. 14(A) and 14(B) are graphs showing the results of detection of the values of currents flowing from the blade at the start of a life test and after printing 20,000 sheets.
Figure 14B:
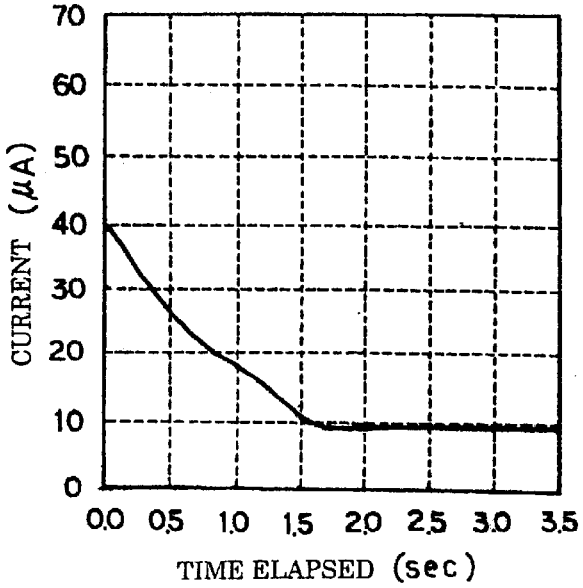

In so constructing and controlling, a developing device capable of producing good images can be provided. Since toner T is applied to the developing roller 5 by triboelectric charging in the above-described nonmagnetic monocomponent developing device, the developing roller 5 and the toner layer forming blade 8 are disposed in pressing contact with a predetermined pressure, thus filming tending to occur frequently on the developing roller 5. FIG. 14 provides the results of life test, showing the value of current flowing from the blade 8 at the start of the life test and after making 20,000 prints. It can be appreciated from the graphs that variation in current can be seen in the state where toner layer is not yet formed on the developing roller 5 (start of detecting) when 20,000 prints have been made, but by using the structure and controlling of the present invention, no variation can be seen when the toner layer on the developing roller 5 is saturated and the current value becomes constant, and it can be thus appreciated that the present invention is effective irrespective of the presence of filming.

Thus, the present invention is characterized in that a toner carry amount is estimated from variation in the value of current flowing from the blade 8 and, if the toner carry amount is determined less than a predetermined value, the toner carry amount is increased so as to compensate for the shortfall by changing the bias voltage for application to the toner feed roller 6 or changing the rotational speed of the toner feed roller. The following will describe more specifically how this characteristic can be realized in the embodiment of the developing device according to the present invention. The print test was conducted under the following conditions with the embodiment of the developing device according to the present invention being incorporated in a laser printer. The printer was operated at a process speed of 32 mm/sec, a 30 mm OPC drum of negative-charge type was used as the photosensitive drum, and rotation of the developing roller 5 was set at 48 mm/sec (corresponding to 1.5 times the speed of the photosensitive drum 4). Furthermore, the surface potential of the photosensitive drum was−550 V, the developing bias for application to the developing roller 5 was −200 V, the feed bias for application to the toner feed roller 6 was −250 V, and the blade bias for application to the blade 8 was −300 V.

Figure 5:
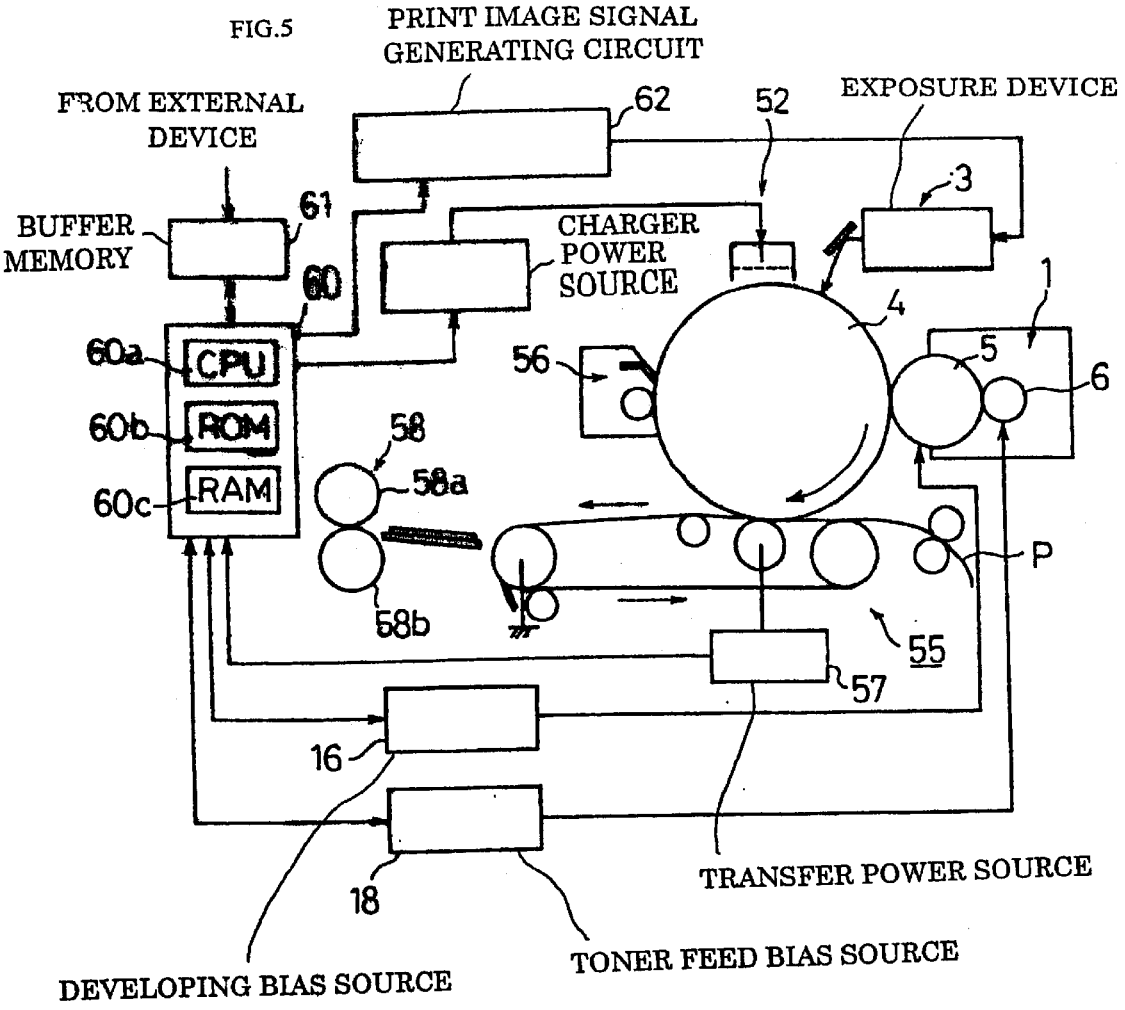
FIG. 5 shows a schematic arrangement of a printer, which has incorporated therein the developing device of FIG. 1.

Referring to FIGS. 1, 5 and 11, the detector 101 for detecting the value of current flowing from the blade 8 is provided with a timer (not shown) which makes possible current monitoring for 12 seconds at maximum. Firstly, currents are detected (S2) at the start of printer operation (at the beginning of rotation of the developing roller) (S1) and at the time (1.2 seconds) during which the developing roller 4 make one complete turn, respectively, and variation in the current value A is found as shown in Table 1. This variation A is stored in RAM 60*c*.

CPU 60*a* compares this variation A with data previously stored in ROM 60*b* as shown in Table 2, and the variations A are classified into levels. Toner quantities at the respective levels by the first turn of the developing roller are as shown in Table 2.

Then, measuring current B flowing from the blade 8 during the time, for example, corresponding to the three turns of the developing roller 4 (or 3.6 seconds), variation in the current values B is found as shown in Table 3. This variation B is stored in RAM 60*c*.

CPU 60*a* compares this variation B with data stored in ROM 60*b* as shown in Table 4, and the variations B are classified into levels. Toner quantities by the three turns of the developing roller for the respective levels are as shown in Table 4.

Then, the toner carry quantities are classified into OK and NG levels as shown in FIG. 5 from the relationship between the above current variations A and B. If both variations A and B fall in any of OK levels of toner carry amount, or in levels 1 or 2, (S4), printing operation is started.

If the variations A and B fall in any NG level of toner carry amount (S5), however, toner feed bias to be added is selected (S6) according to data in Table 6 in which NG levels are classified into five stages or positions and stored in ROM 60*b* and Table 7 which provides values of bias voltages stored in ROM 60*b* for addition to the toner feed roller 6 depending on the respective stages or positions.

On the other hand, ROM 60*b* stores therein data of voltage-bit table in which the all toner feed bias voltages from the voltage source between the maximum and minimum values thereof are divided into 256 sections. That is, since the minimum value of toner feed bias voltage is 0 V and maximum value is −1000 V in the embodiment of the present invention, 1 bit corresponds to −4 V ( −1000/256). Thus, the voltage:bit table is provided as shown in Table 8, and the toner feed bias for actual application is substituted by bit for storage in ROM 60*b*.

As shown in Table 9, the above selected additional toner feed bias is substituted by an appropriate bit number as mention above. That is, when the additional toner feed bias voltage is decided, bit number corresponding to the toner feed bias voltage is selected from the conversion table of Table 9 stored in ROM 60*b* and such voltage is added to the toner feed bias for actual application. For example, if bias for actual application is −300 V (75 bits) and NG level is position P1, the additional voltage is −50 V (13 bits) according to Table 9 and the toner carry amount corresponding to 88 bits (75 bits+13 bits) is commanded, accordingly.

Although in the above embodiment a typical case has been described in which the bias voltage (toner feed bias) for application to the toner feed roller is changed so as to increase the toner carry amount, it may be so arranged that the rotational speed of the toner feed roller is increased as indicated earlier. In the latter case, the rotational speed of the toner feed roller may be changed in accordance with the position in Table 6 instead of adding to the toner feed bias. For example, with the toner feed roller rotated at 48 mm/sec (the same speed as the developing roller) at the start of printer operation, good results could be achieved by changing the speed for each position as indicated in Table 10. As a simple method of changing the rotational speed, a resistance corresponding to each position is inserted between the toner feed roller drive motor and power source thereof so that the voltage for application to the motor is changed by changing the resistance by means of an actuator when an appropriate position is selected, thereby to change the rotational speed.

Furthermore, although the embodiments have been described with reference to nonmagnetic monocomponent development using a photosensitive drum of negative-charge type for reverse development, the present invention is also applicable to nonmagnetic monocomponent development using a photosensitive drum of positive-charge type for normal development.

It is apparent from the foregoing that, according to the embodiments of the present invention, toner layer on the developing roller is once recovered by a toner feed roller, current of the toner layer forming member is monitored with no toner layer formed on the developing roller, and the value of current flowing in the toner layer forming member is detected when toner is transferred to the developing roller at the beginning of printing operation, whereby controlling for stabilized toner carry amount at all times can be made possible.

What is claimed is:

1. A developing device in an image forming apparatus of monocomponent development type, wherein a developing roller is supplied with toner from a toner feed roller to form thereon a toner layer through application of a bias voltage to a toner layer forming member, while said toner layer forming member is pressed against said developing roller, comprising:

a toner recovery system for recovering toner from said developing roller;

a current variation detector for detecting variations in current flowing through said toner layer forming member applied with the bias voltage when feeding toner, during image forming operation, onto said developing roller from which the toner has been recovered by said toner recovery system; and a toner carry amount controller for controlling an amount of toner carried onto said developing roller on the basis of said variations in current.

2. A developing device in an image forming apparatus as set forth in claim 1, characterized in that said current variation detector comprises:

a current detector for detecting current flowing through said toner layer forming member;

a timer for counting time; and computing means for determining a difference in value of currents detected by said current detector before and after a predetermined time counted by said timer.

3. A developing device in an image forming apparatus as set forth in claim 2, characterized in that said predetermined time is counted from a beginning of rotation of said developing roller.

4. A developing device in an image forming apparatus as set forth in claim 1, characterized in that:

said current variation detector is operable to detect variations in current for each of first and second predetermined times having different lengths as counted from a beginning of rotation of said developing roller; and that said toner carry amount controller is operable to control said toner carry amount on the basis of said detected current variation amounts for said first and second predetermined times.

5. A developing device in an image forming apparatus as set forth in claim 4, characterized in that said toner carry amount controller has tables of data of control quantities corresponding to the respective current variation amounts for said first and second predetermined times and is operable to control said toner carry amount on the basis of the control quantities found from said tables.

6. A developing device in an image forming apparatus as set forth in claim 1, characterized in that said toner carry amount controller is operable to change the bias voltage for application to said toner layer forming member on the basis of said variations in current.

7. A developing device in an image forming apparatus as set forth in claim 1, characterized in that said toner carry amount controller operates to change the rotational speed of said toner feed roller on the basis of said variations in current.

8. A developing device in an image forming apparatus as set forth in claim 1, characterized in that said toner carry amount controller is operable so as to increase the toner carry amount if said controller determines on the basis of said variations in current that an amount of toner carried to said developing roller is at or below a predetermined amount, or under a predetermined amount.

9. A developing method in an image forming apparatus of monocomponent development type, wherein a developing roller is supplied with toner from a toner feed roller to form thereon a toner layer through application of a bias voltage to a toner layer forming member, while said toner layer forming member is pressed against said developing roller, comprising the steps of:

recovering toner from said developing roller by said toner feed roller at the end of image forming operation of said image forming apparatus;

detecting variations in current flowing through said toner layer forming member during re-supply of toner to said developing roller at the start of image forming operation of said image forming apparatus; and controlling an amount of toner carried onto said developing roller by said toner feed roller on the basis of said variations in current.

10. An image forming apparatus comprising:

a photoreceptor on which a latent image is formed;

a developing roller for visualizing the latent image by feeding toner to said photoreceptor;

a toner feed roller for feeding toner to said developing roller;

a toner layer forming member applied with a bias voltage and pressed against said developing roller to form a toner layer on said developing roller;

a toner recovery system for recovering toner on said developing roller;

a current variation detector for detecting variations in current flowing through said toner layer forming member applied with the bias voltage when feeding toner, during image forming operation, onto said developing roller from which the toner has been recovered by said toner recovery system; and a toner carry amount controller for controlling an amount of toner carried onto said developing roller on the basis of said variations in current.

* * * * *